United States Patent [19]

Scaroni

[11] Patent Number: 5,065,885

[45] Date of Patent: Nov. 19, 1991

[54] AIRTIGHT CONTAINER

[75] Inventor: Damiano Scaroni, Lumezzane-Pieve, Italy

[73] Assignee: Scaroni F.lli S.p.A., Italy

[21] Appl. No.: 478,157

[22] Filed: Feb. 9, 1990

[51] Int. Cl.[5] ..... B65D 45/22

[52] U.S. Cl. ..... 220/326; 220/378

[58] Field of Search ..... 220/378, 254, 308, 322, 220/356, 357, 358, 355, 354, 353, 326, 324, 323, 315, 319, 263, 259, DIG. 10

[56] References Cited

U.S. PATENT DOCUMENTS

| | | | |
|---|---|---|---|
| 2,117,807 | 5/1938 | Jesser | 220/357 |
| 2,723,142 | 11/1955 | Stebbins | 220/358 X |
| 3,416,701 | 12/1968 | Kramer et al. | 220/318 |
| 4,166,548 | 9/1979 | Crisci | 220/308 |
| 4,177,934 | 12/1979 | Hammes et al. | 220/319 |
| 4,267,940 | 5/1981 | Wade | 220/378 X |
| 4,347,947 | 9/1982 | Hammes | 220/319 X |
| 4,585,138 | 4/1986 | Jonkers | 220/308 X |
| 4,614,280 | 9/1986 | Wightman | 220/610 |
| 4,674,650 | 6/1987 | Hamilton et al. | 220/355 X |
| 4,915,913 | 4/1990 | Williams et al. | 220/324 X |

*Primary Examiner*—Stephen Marcus
*Assistant Examiner*—Vanessa Caretto
*Attorney, Agent, or Firm*—Lalos & Keegan

[57] ABSTRACT

An airtight container for foods having a base vessel and a cover that can form an airtight seal. The cover is provided with a gasket around the perimeter and an alignment or locating means cooperating with the base vessel for quick and easy alignment and a hinge or clamp that pulls down the cover to force a gasket positioned in a perimeter annulus of the cover to deform the gasket and form the airtight seal. The hinge or clamp is easily operated to cause the pull down of the cover and form the seal and easily released.

43 Claims, 2 Drawing Sheets

AIRTIGHT CONTAINER

BACKGROUND OF THE INVENTION

Food containers are well known and in common use in this country and throughout the world. Particularly food containers that would be typically used in the storage of food in a refrigerator or a freezer. Such food containers have been made of various plastics and include polyethylene bags, polypropylene containers, polyvinyl chloride reuseable cans. Some of these prior art containers have sealing means that attempt to attain an airtight seal. Often such an airtight seal, if attainable, can only be achieved after very careful pressure is applied about the perimeter of the cover and even then it cannot be certain that a continuous airtight seal is made throughout the perimeter contact between the cover and the bottom vessel.

In order to attain a proper seal between the cover and the bottom vessel it usually has been important to have a proper alignment between the cover and the bottom vessel usually at the perimeter where the sealing would take place. The simplicity of alignment as being an important factor is well understood. However in practice it is not easily attained. Thus both alignment and some form of pressure is important in order to attain a proper seal to produce reliable airtightness for the storage of food.

Following the essential requirement of a complete and reliable airtight seal is the secondary but also important requirement that the seal be easily releasable so that the contents of the bottom vessel would be readily available. Unsecuring of the seal of many prior art containers is not quick, is not easy, nor has it been satisfactory.

In addition to the requirements of an easily formed and effective airtight seal and the releasability of the seal, the commercial requirements dictate that the appearance of the product be acceptable to the public who would be users of the airtight sealed container.

An industrial model patent was obtained by the present assignee in Italy on Mar. 25, 1989, No. 51468, on an application that was filed with Serial No. 6979B/87 on Apr. 10, 1987. This Italian Industrial Model Patent discloses only the external features of the container and does not disclose the means for achieving an airtight seal, the aligning capabilities, nor the means for applying the pressure to achieve and perfect the airtight seal.

OBJECTS OF THE PRESENT INVENTION

It is therefore the principal object of the present invention to provide an airtight container that provides a quick and easy means for achieving an airtight condition to preserve and protect the contents.

Another object of the present invention is to provide an airtight sealable container that permits easy release of the airtight seal for access to the contents of the container.

Another object of the present invention is to produce a user-friendly airtight container wherein the container lid or cover can be easily aligned with the bottom vessel so that the airtight seal can be easily and quickly attained.

A further and also important object of the present invention is the provision of means to provide a pressure to pull down the cover of the container onto the bottom vessel so that the seal may be airtight and effective.

A further object of the present invention is the provision of a novel hinge clamp that operates in a simple and effective manner to pull down the cover onto the perimeter of the bottom vessel to effect an efficient seal.

It is also a further object of the present invention to provide a seal on the cover of the container forming the present invention in which the seal is positioned and held in place so that continuous and effective sealing contact can be made easily and efficiently with the coacting sealing member along or adjacent the perimeter of the bottom vessel.

SUMMARY OF THE INVENTION

The container of the present invention is suitable for food storage and comprises a base vessel having a perimeter that is provided with a continuous upstanding rim and a cover to fit over the open vessel to close or seal the vessel. The cover is provided with a depending lip spaced inwardly from walls forming the cover and between the walls and the lips there is formed an annulus continuously around the perimeter of the cover. A gasket is positioned within the annulus for contact with the upstanding rim adjacent the perimeter of the vessel and a closure pivotally operable between the cover and the vessel is positioned to apply pressure between the upstanding rim and the gasket to produce a sealing contact.

The foregoing objects of the present invention are believed to be met by the following description of the present invention when taken in conjunction with the two sheets of drawings.

THE DRAWINGS

DESCRIPTION OF THE PREFERRED EMBODIMENT

Figure 1:
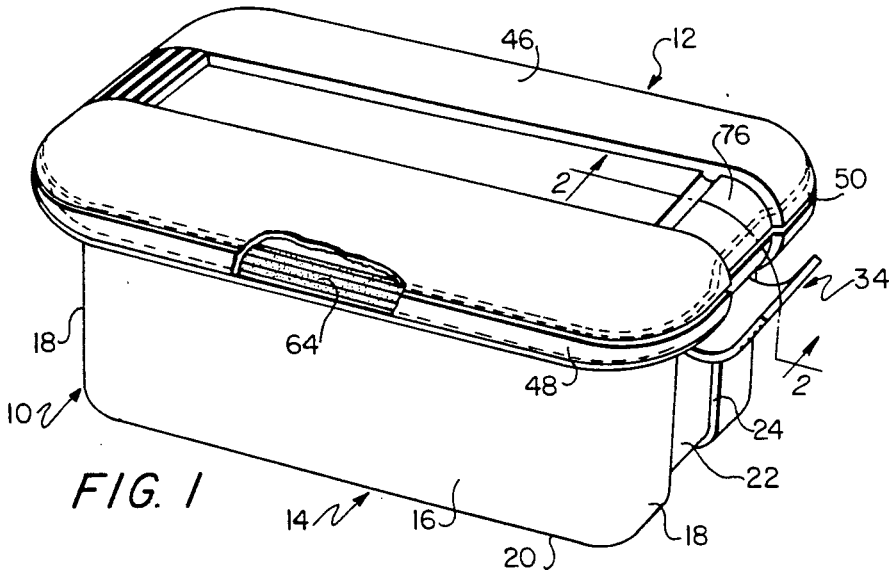
FIG. 1 is a perspective view partly in section of a first embodiment of the airtight container forming the present invention.

The present invention is in the form of two embodiments as shown in the drawings, FIGS. 1 through 10. Each of these embodiments is similar to each other. However they have one essential difference that will be evident as the description of these embodiments proceeds.

FIGS. 1 through 6 disclose a first embodiment. FIG. 1 illustrates the container at 10 that may be made of any plastic, however conventional polymethacrylate is a preferred material. The container 10 includes a cover shown generally at 12 and a bottom vessel shown generally at 14. The vessel 14 is composed of a pair of opposed side panels 16, however, the opposite panel 16 is not shown. A pair of end panels 18 with only one shown is also present. The vessel also includes a bottom 20 to join with the side panels 16 and end panels 18.

Figure 6:
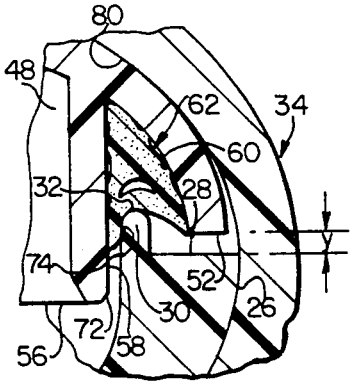
FIG. 6 is an enlarged view taken along circle 6 of Figure 4 and illustrating in a magnified form the structure of the annulus, the gasket and the upstanding rim around the perimeter of the bottom vessel.

The end panels 18 are indented as best shown in FIG. 1 to provide a central end panel 22 that meets the outer end panels 18 at the shoulder panel 24. The central end panel 22 is continuous from the bottom 20 up to the perimeter 26 of the shoulder panel 24. At the top of the shoulder panel 24 is a ledge 28 that is essentially planar and parallel to the bottom 20. Spaced inwardly from the ledge 28 is an upstanding rim 30. The upstanding rim 30 may be tapered at its leading edge 32 as best shown in FIG. 6.

Figure 2:
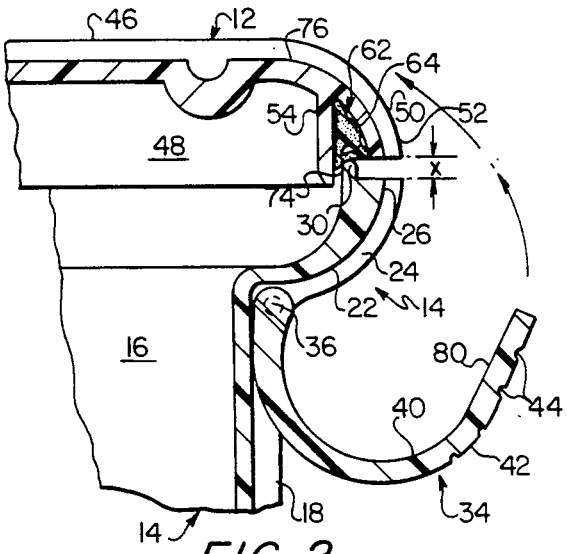
FIG. 2 is a cross-sectional view taken along lines 2—2 of FIG. 1 and partly broken away illustrating the hinge or clamp in the fully released position and also illustrating the cover being aligned and in a first position awaiting the sealing upon movement of the hinge to its fully closed position.
Figure 3:
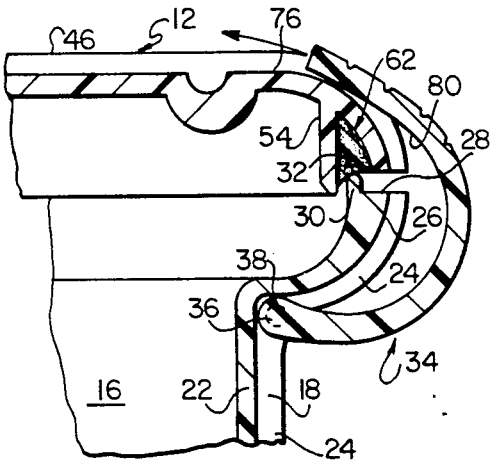
FIG. 3 is a cross-sectional view partly broken away similar to FIG. 2 illustrating an intermediate position for the hinge or clamp as it moves to the locked position and is beginning to force the cover to the second position on the bottom vessel.
Figure 4:
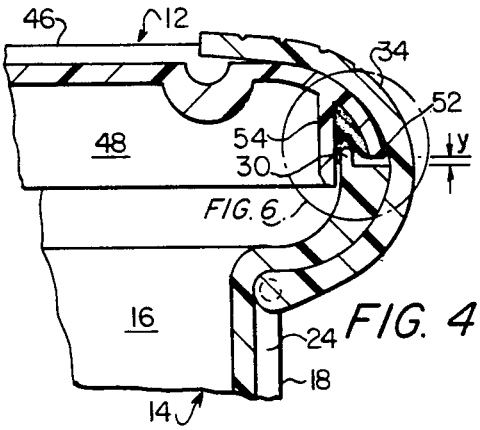
FIG. 4 is a view similar to FIGS. 2 and 3 but showing the final closed position where the cover is pulled down to effectively seal the perimeter of the vessel.

A closure 34 is in the form of a pair of C-shaped clamps or hinges, 35, as shown in FIGS. 2, 3 and 4, that are pivoted at pivot points 36 to the shoulder panels 24 by the use of any suitable pivot pins that, as shown, connect one end of the hinge 35 to the shoulder panel 24 in a conventional manner. The hinge 35 is preferably made from a hard but resilient plastic such as nylon that has a slight resiliency and a memory. The clamp or hinge 35 is preferably of a width that fits between the shoulder panels 24 and is of an approximate thickness substantially equal to the depth of the shoulder panels so that when it is pivoted upwardly into position as shown in FIG. 4, the undersurface 40 of the hinge or clamp can be flush with the shoulder panel 24 as best shown in FIG. 4. As shown in this embodiment, the outer surface 42 of the closure forming the hinge/clamp 35 is a plurality of parallel grooves 44 to provide friction to the user for movement of the hinge/clamp 35. The dimensions and operation of the clamp 35 forming the closure 34 will be discussed further after a detailed description of the structure of the cover 12.

The cover 12 is provided with a top 46, side walls 48 that are opposed and connected to the top 46, and a pair of opposed end walls 50 at the perimeter 52. The end wall 50 as well as side walls 48 are curved downwardly from the top as is shown for the end walls 50 of the cover in FIGS. 2, 3 and 4. The side walls 48 are also shown to be curved in the FIG. 1 perspective.

Inwardly spaced from the end walls 50, as well as side walls 48, is a depending lip 54 that extends continuously around the inside of the cover. Preferably the depending lip extends below the level of the end wall 50 as shown at 56. The internal surface 58 of the depending lip 54 and the internal surface 60 of end wall 50 form an annulus 62 that is continuous around the periphery of the cover.

Figure 5:
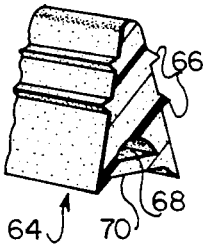
FIG. 5 is a perspective view in cross-section of the continuous gasket that is positioned within the annulus formed continuously around the perimeter of the cover.

The annulus 62 is triangularly shaped in cross-section as shown in the drawings to receive a gasket 64 as best shown in FIG. 5. This gasket is A-shaped and preferably formed of a silicon rubber composition or other soft resilient material well known to those skilled in the art. The gasket is provided with a plurality of ribs 66 which run continuously the length of the gasket that is itself continuous to fit in the annulus around the cover. The gasket 66 is also provided with a half moon shaped in cross-section, hollow portion 68 that runs the entire length of the gasket 64. The hollow portion forms a lower bridge 70 that is to be used to contact the upstanding rim 30 as will be discussed subsequently.

The depending lip as stated is extended downwardly at 56 to form the internal surface 58 on the depending lip as previously stated. Opposed vertical surface 74 of the upstanding rim 30 forms in part a locating or alignment means to assure that the cover when placed on top of the vessel is in proper alignment. These two surfaces, as clearly shown in FIGS. 2 through 6, are opposed to each other and only when in the opposed condition would the cover be properly aligned on the bottom vessel so that it may subsequently be closed and sealed in an airtight manner.

It is also to be understood that in the initial o first position of the cover on the bottom vessel, the upstanding rim 30 is in contact with the bottom of the bridge 70 as shown in FIG. 2 and any deformation that may be produced in the gasket 64 and, in particular the bridge 70 in this initial position, is simply because by the weight of the cover.

The cover is provided with a cammable surface 76 that is formed slightly below the surface of the top 46 of the cover. At a position moved from the end wall 50 and forming a part of the cammable surface 76 is a depression 78.

To effect a seal of the cover 12 on the bottom vessel 14 it is necessary to deform the gasket 64 by the upstanding rim 30. To achieve this end, it should be noted that the undersurface 40 of the hinge or clamp 35 provides a camming surface 80 for the hinge or clamp 35 and that the distance A between the camming surface 80 and the pivot point 36 is less than the distance B between pivot point 36 and the cammable surface 76 on the cover.

In the first or initial position as shown in FIG. 2, the space between the bottom of the end wall 50 and the ledge 28 is shown in FIG. 2 at x. As the hinge or clamp is moved to the position of FIG. 3 and the camming surface 80 comes in contact with the cammable surface 76, the cover will be pulled down so that the spacing between the bottom of end wall 50 and the ledge 28 is reduced to dimension y as shown in FIGS. 4 and 6, which could be negligible. The distances A and B referred to above are now approximately equal.

In the final or closed position of FIG. 4 the hinge or clamp is held in place by the friction between the cammable surface and the camming surface and the contact area between these two surfaces, which is approximately vertically above the pivot point 36. In this final or second position of the cover and bottom vessel as shown in FIG. 4, the container is sealed airtight because the upstanding rim 30 significantly deforms the bridge 70 by pushing the bridge into the hollow portion 68 and deforms the gasket into the annulus, as best shown in FIG. 6 to prevent any air moving into or out of the container so sealed.

In the preferred embodiment of the invention as illustrated in FIGS. 7 through 10 there is shown a preferable structure because it is provided with a secure releasable locking feature that is not present in the embodiment previously described.

Figure 7:
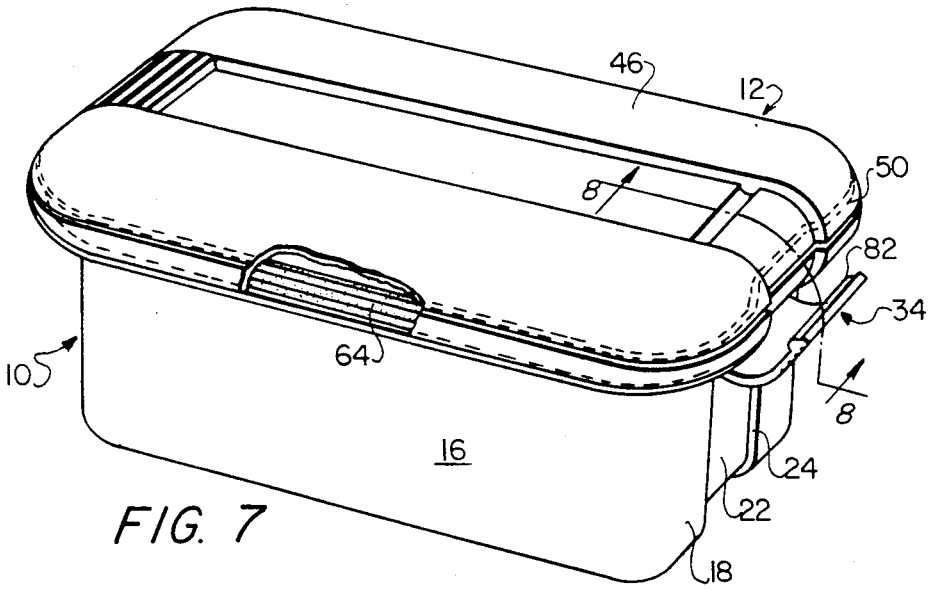
FIG. 7 is a perspective view partly in section similar to FIG. 1 but showing a second and preferred embodiment of the present invention.

The operation and structure of the embodiment of FIGS. 7 through 10 is precisely the same as that previously described with the exception that a boss or bump 82 is provided on the hinge or clamp 35 and positioned on the undersurface to form a camming surface 84 that is concentrated at the outermost point of the boss 82. The boss, as best shown in FIG. 7, extends preferably though not necessarily the entire width of the hinge or clamp 35 and is positioned at a point distal to the pivot point 36.

Figure 8:
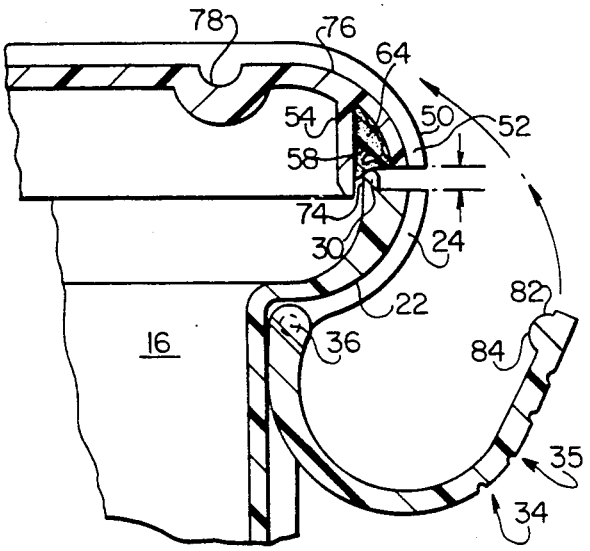
FIG. 8 is a cross-sectional view partly broken away taken along lines 8—8 of FIG. 7 and illustrating the fully open position of the hinge or clamp and the alignment of the cover onto the bottom vessel.
Figure 9:
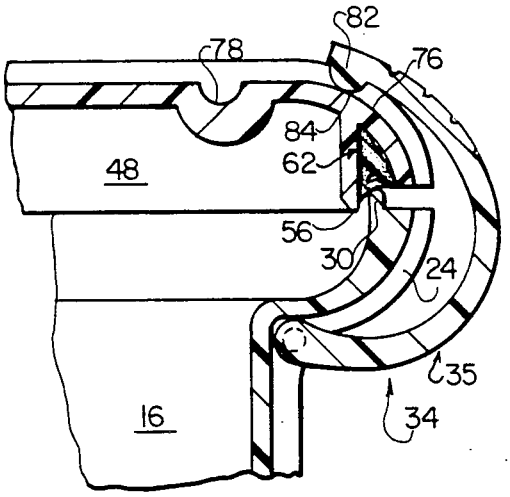
FIG. 9 is a cross-sectional view partly broken away similar to FIG. 8 but showing an intermediate position for the hinge or clamp before it affects a locking seal when the boss on the clamp engages the depression on the cover.
Figure 10:
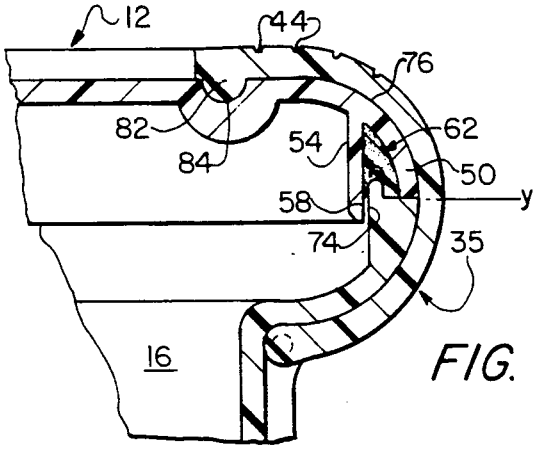
FIG. 10 is a cross-sectional view partly broken away similar to FIGS. 8 and 9 and illustrating the fully locked and secure position wherein the boss of the hinge or clamp has fully penetrated the depression on the cover to pull the cover down into its sealing position wherein the upstanding rim is fully embedded into the gasket positioned within the annulus.

Thus, as clearly illustrated in FIGS. 9 and 10, the hinge or clamp 35 upon being moved from the first position of the cover and vessel, as shown in FIG. 8, to the intermediate position, as shown in FIG. 9, the camming surface 84 deforms the hinge or clamp 35 in part and also provides significant force to pull down the cover 12 by acting on the cammable surface 76 of the cover. While the hinge clamp 35 may deform slightly, the force imparted by the hinge or clamp through the cam surfaces 76 and 84 would be sufficient to pull down the cover so that the upstanding rim 30 deforms the bridge 70 and the hollow portion 68 of the gasket 64 to form the initial step towards a seal. As shown in FIG. 10, the operation is completed where the boss 82 is received within the depression 78 to form a secure lock from which the clamp cannot be removed unless and until the user forceably pushes the hinge clamp 35 to the right as shown in FIG. 10. The boss is then moved out of the depression 78 onto the cammable surface 76 and upon continuing this action, the hinge clamp will drop off by the side as in FIG. 8 permitting the cover to be removed from the bottom vessel.

It is believed that the objects of the present invention have been satisfied by the structure of the two embodiments as described above. The scope of the patent protection sought should be therefore limited solely in accordance with the following claims wherein

I claim:

1. A container suitable for food storage comprising:

a base having a bottom, side panels and opposed end panels integral with said bottom to form an open vessel, said vessel having a perimeter formed at the top thereof, said perimeter having a continuous upstanding rim inside of the perimeter and extending above said vessel;

said end panels having an indented central end panel portion which meets said outer end panels at a shoulder panel, said central and shoulder panels being continuous from said bottom up to said perimeter, a cover to fit over the open vessel to close said vessel, said cover having a top, opposed side walls and end walls and said cover having a perimeter substantially similar to the perimeter of said vessel, said cover having an indented central surface disposed in aligning relationship with the surface of said central end panel portion of said vessel when said cover is fitted thereupon, said cover having a depending lip spaced inwardly from said walls, said lip and said walls forming an annulus continuously around said perimeter of said cover, a gasket positioned within said annulus for contact with said upstanding rim, a closure connected to said container at said central end panel portion of said vessel and operable between said central surfaces of said cover and said central end panel portion of said vessel for applying pressure between said upstanding rim and said gasket to produce sealing contact between said rim and said gasket.

2. The container of claim 1 including, said gasket being silicon.

3. The container of claim 1 including, said gasket being provided with a plurality of external ribs for contact with the internal surfaces of said annulus.

4. The container of claim 1 including, said gasket having a hollow portion coextensive with the length of said gasket.

5. The container of claim 1 including, said gasket being A shaped to fit within said annulus.

6. The container of claim 1 including, said gasket being provided with a plurality of external ribs for contact with the internal surfaces of said annulus, said gasket having a hollow portion coextensive with the length of said gasket, and said gasket being A shaped to fit within said annulus.

7. The container of claim 1 including, said annulus being wedge shaped.

8. The container of claim 1 including, said annulus being wedge shaped, said gasket being provided with a plurality of external ribs for contact with the internal surfaces of said annulus, said gasket having a hollow portion coextensive with the length of said gasket, and said gasket being A shaped to fit within said annulus.

9. The container of claim 1 including, a ledge formed between said upstanding rim and said perimeter of said vessel, said ledge being planar and essentially parallel to the plane of said base.

10. The container of claim 9 including, said ledge being positioned below the top of said upstanding rim.

11. The container of claim 1 including, said depending lip of said cover being spaced inwardly from said upstanding rim.

12. The container of claim 1 including, said depending lip including locating means to determine the position of said cover when on top of said vessel.

13. The container of claim 12 including, said locating means including an internal surface of said annulus and including a vertical surface of said upstanding rim.

14. The container of claim 1 including, a ledge formed between said upstanding rim and said perimeter of said vessel, said ledge being planar and essentially parallel to the plane of said base, said ledge being positioned below the top of said upstanding rim, and said depending lip of said cover being spaced inwardly from said upstanding rim.

15. The container of claim 1 including, a ledge formed between said upstanding rim and said perimeter of said vessel, said ledge being planar and essentially parallel to the plane of said base, said ledge being positioned below the top of said upstanding rim, said depending lip of said cover being spaced inwardly from said upstanding rim, said depending lip including locating means to determine the position of said cover when on top of said vessel, and said locating means including an internal surface of said annulus and including a vertical surface of said upstanding rim.

16. The container of claim 1 including, said gasket being provided with a plurality of external ribs for contact with the internal surfaces of said annulus, said gasket having a hollow portion coextensive with the length of said gasket, said gasket being A shaped to fit within said annulus, and said depending lip of said cover being spaced inwardly from said upstanding rim.

17. The container of claim 1 including, said annulus being wedge shaped, said gasket being provided with a plurality of external ribs for contact with the internal surfaces of said annulus, said gasket having a hollow portion coextensive with the length of said gasket, said gasket being A shaped to fit within said annulus, and said depending lip including locating means to determine the position of said cover when on top of said vessel.

18. The container of claim 1 including, said gasket having a hollow portion coextensive with the length of said gasket, said gasket being A shaped to fit within said annulus, and said depending lip including locating means to determine the position of said cover when on top of said vessel.

19. The container of claim 1 including, said gasket being provided with a plurality of external ribs for contact with the internal surfaces of said annulus, said gasket having a hollow portion coextensive with the length of said gasket, said gasket being A shaped to fit within said annulus, and said depending lip including locating means to determine the position of said cover when on top of said vessel.

20. The container of claim 1 including, said annulus being wedge shaped, said gasket being provided with a plurality of external ribs for contact with the internal surfaces of said annulus, said gasket having a hollow portion coextensive with the length of said gasket, said gasket being A shaped to fit within said annulus, said depending lip including locating means to determine the position of said cover when on top of said vessel, and said locating means including an internal surface of said annulus and including a vertical surface of said upstanding rim.

21. The container of claim 1 including, said annulus being wedge shaped, said gasket being provided with a plurality of external ribs for contact with the internal surfaces of said annulus, said gasket having a hollow portion coextensive with the length of said gasket, said gasket being A shaped to fit within said annulus, a ledge formed between said upstanding rim and said perimeter of said vessel, said ledge being planar and essentially parallel to the plane of said base, said ledge being positioned below the top of said upstanding rim, and said depending lip of said cover being spaced inwardly from said upstanding rim.

22. The container of claim 1 including, said annulus being wedge shaped, said gasket being provided with a plurality of external ribs for contact with the internal surfaces of said annulus, said gasket having a hollow portion coextensive with the length of said gasket, said gasket being A shaped to fit within said annulus, a ledge formed between said upstanding rim and said perimeter of said vessel, said ledge being planar and essentially parallel to the plane of said base, said ledge being positioned below the top of said upstanding rim, said depending lip of said cover being spaced inwardly from said upstanding rim, said depending lip including locating means to determine the position of said cover when on top of said vessel, and said locating means including an internal surface of said annulus and including a vertical surface of said upstanding rim.

23. The container of claim 1 including, said closure being a hinged clamp pivotable between said vessel and said cover.

24. The container of claim 23 including, said hinged clamp having a camming surface towards one end and pivot means connected to said vessel at a pivot point at the other end of said hinged clamp.

25. The container of claim 23 including, a cammable surface positioned on said top of said cover.

26. The container of claim 23 including, said hinged clamp having a camming surface towards one end and pivot means connected to said vessel at a pivot point at the other end of said hinged clamp, a cammable surface positioned on said top of said cover, the distance between said pivot point and said camming surface being less than the distance between said pivot point and cammable surface when said cover is in a nonsealed first position relative to said vessel.

27. The container of claim 23 including, said hinged clamp having a camming surface towards one end and pivot means connected to said vessel at a pivot point at the other end of said hinged clamp, a cammable surface positioned on said top of said cover, and the distance between said pivot point and said camming surface being approximately equal to the distance between said pivot point and said cammable surface when said cover is in a sealed second position relative to said vessel.

28. The container of claim 27 including, in said second position, said upstanding rim projects into said annulus to deform said gasket and form an airtight seal between said cover and said vessel.

29. The container of claim 24 including, said camming surface being a boss positioned on the under surface of said hinged clamp.

30. The container of claim 23 including, said hinged clamp having a camming surface towards one end and pivot means connected to said vessel at a pivot point at the other end of said hinged clamp, said camming surface being a boss positioned on the under surface of said hinged clamp, a cammable surface positioned on said top of said cover, and said cammable surface including a depression for receiving said boss to releasably lock said hinged clamp securely in a sealed position.

31. The container of claim 23 including, said hinged clamp being resilient.

32. The container of claim 23 including, said hinged clamp having a camming surface towards one end and pivot means connected to said vessel at a pivot point at the other end of said hinged clamp, said camming surface being a boss positioned on the under surface of said hinged clamp, and a cammable surface positioned on said top of said cover.

33. The container of claim 1 wherein said closure is a hinged clamp pivotable between said vessel and said cover.

34. The container of claim 33 wherein said hinged clamp is pivoted at a pair of pivot points located at said shoulder panels.

35. The container of claim 33 wherein said hinged clamp is of a width substantially equal to the width of said central end panel portion.

36. A container suitable for food storage comprising, a base having a bottom, side panels and opposed end panels integral with said bottom to form an open vessel, said end panels having an indented central end panel portion which meets said outer end panels at a shoulder panel, said central and shoulder panels being continuous from said bottom up to said perimeter, said vessel having a perimeter formed at the top thereof, said perimeter having a continuous upstanding rim extending above said vessel, a cover to fit over the open vessel to close said vessel, said cover having a top, opposed side walls and end walls and said cover having an annulus extending along a perimeter substantially similar to the perimeter of said vessel, said cover having an indented central surface disposed in aligning relationship with said central end panel portion of said vessel when said cover is fitted thereupon, (support spec p. 9)

a gasket positioned within said annulus for contact with said upstanding rim, a closure connected to said container at said central end panel portion of said vessel and operable between said central surfaces of said cover and said vessel for applying pressure between said upstanding rim and said gasket to produce sealing contact between said rim and said gasket.

37. The container of claim 36 including, said closure being a hinged clamp pivotable between said vessel and said cover, said hinged clamp having a camming surface towards one end and pivot means connected to said vessel at a pivot point at the other end of said hinged clamp, and a cammable surface positioned on said top of said cover.

38. The container of claim 36 including, said closure being a hinged clamp pivotable between said vessel and said cover, said hinged clamp having a camming surface towards one end and pivot means connected to said vessel at a pivot point at the other end of said hinged clamp, said camming surface being a boss positioned on the under surface of said hinged clamp, and a cammable surface positioned on said top of said cover.

39. The container of claim 36 including, said closure being a hinged clamp pivotable between said vessel and said cover, said hinged clamp having a camming surface towards one end and pivot means connected to said vessel at a pivot point at the other end of said hinged clamp, said camming surface being a boss positioned on the under surface of said hinged clamp, a cammable surface positioned on said top of said cover, and said cammable surface including a depression for receiving said boss to releasably lock said hinged clamp securely in a sealed position.

40. The container of claim 36 including, said hinged clamp having a camming surface towards one end and pivot means connected to said vessel at a pivot point at the other end of said hinged clamp, said camming surface being a boss positioned on the under surface of said hinged clamp, and a cammable surface positioned on said top of said cover.

41. The container of claim 36 wherein said closure is a hinged clamp pivotable between said vessel and said cover.

42. The container of claim 41 wherein said hinged clamp is pivoted at a pair of pivot points located at said shoulder panels.

43. The container of claim 41 wherein said hinged clamp is of a width substantially equal to the width of said central end panel portion.

* * * * *